United States Patent [19]

Pia

[11] Patent Number: 4,894,035

[45] Date of Patent: Jan. 16, 1990

[54] WATER CRAFT

[76] Inventor: Francesco A. Pia, 3 Boulder Brae La., Larchmont, N.Y. 10538

[21] Appl. No.: 263,612

[22] Filed: Oct. 27, 1988

Related U.S. Application Data

[63] Continuation of Ser. No. 89,270, Aug. 25, 1987, abandoned.

[51] Int. Cl.[4] ..... A63C 15/00

[52] U.S. Cl. ..... 441/79; 441/65; 441/74

[58] Field of Search ..... 114/39.2, 56, 288; 441/65, 74, 79

[56] References Cited

U.S. PATENT DOCUMENTS

| | | | |
|---|---|---|---|
| 3,289,227 | 12/1966 | Kelly | 441/74 |
| 3,455,261 | 7/1969 | Perrin | 114/39.2 |
| 4,587,917 | 5/1986 | Cantin | 114/39.1 |
| 4,710,143 | 12/1987 | Boulanger | 441/65 |
| 4,767,370 | 8/1988 | Campbell | 441/74 |

FOREIGN PATENT DOCUMENTS

| | | | |
|---|---|---|---|
| 2833960 | 2/1980 | Fed. Rep. of Germany | 441/79 |

*Primary Examiner*—Sherman D. Basinger
*Assistant Examiner*—Thomas J. Brahan
*Attorney, Agent, or Firm*—Kenyon & Kenyon

[57] ABSTRACT

A water craft is of one-piece construction having a bow section provided on the underside with a pair of parallel runners and a recessed central portion. In addition, the craft has a stern section which narrows toward the rear and which has a chine on the underside in spaced relation to the runners to provide two channels for a flow of water. A stern section also has a flat deck for seating or standing of a user thereon depending upon the use of the craft, for example, as a rescue craft or as a sail boat.

21 Claims, 2 Drawing Sheets

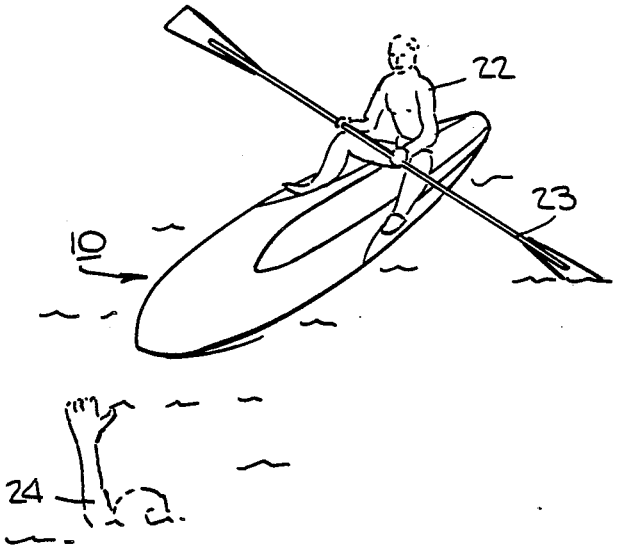
Fig. 1.
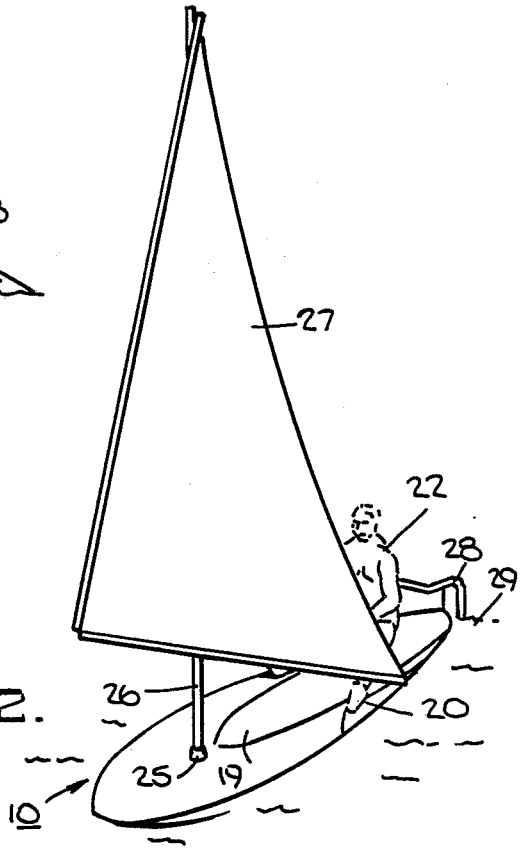
Fig. 2.
Fig. 3.
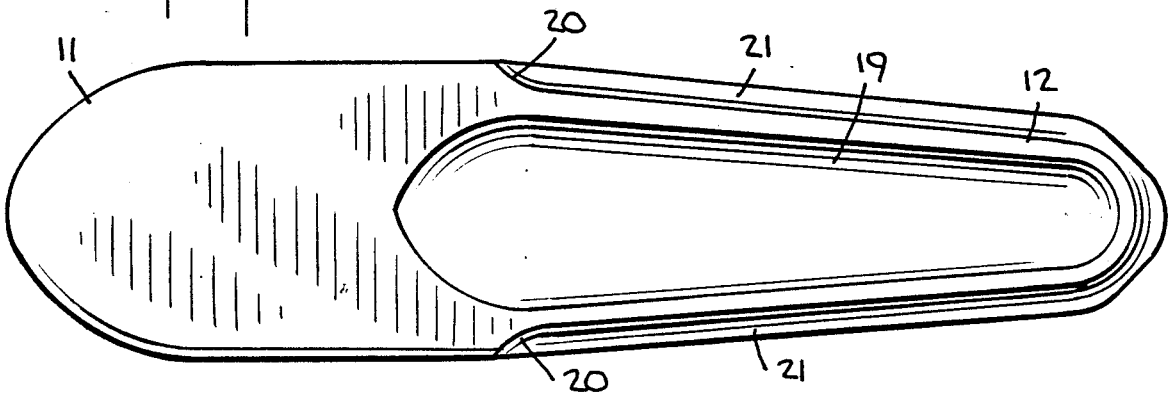
Fig. 4.
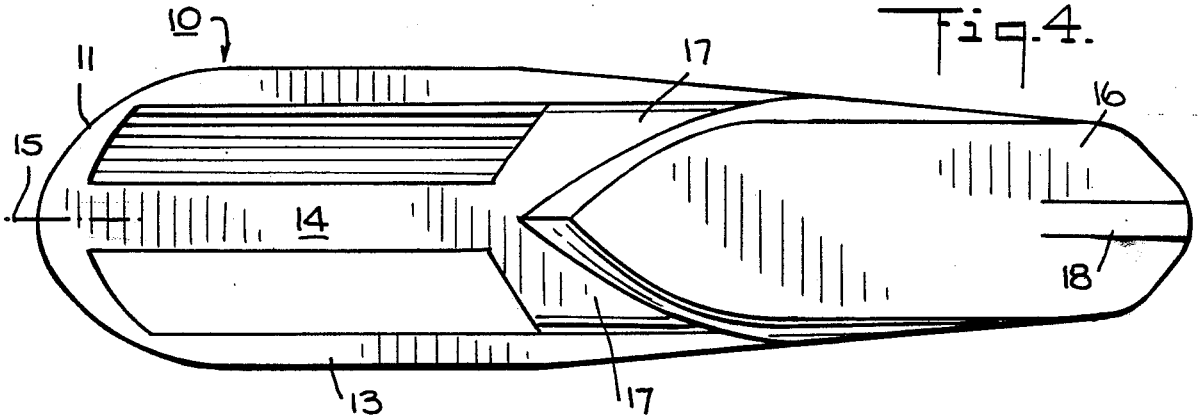

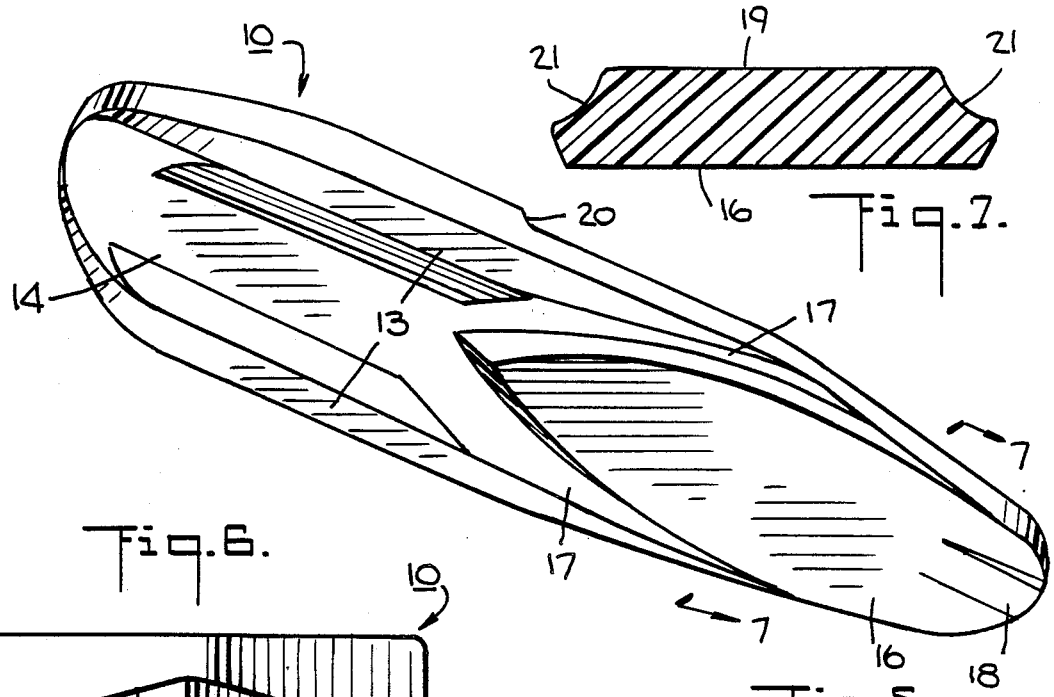
Fig. 7.
Fig. 5.
Fig. 6.
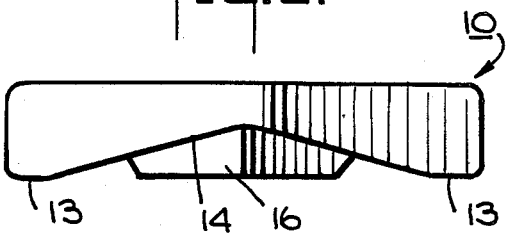
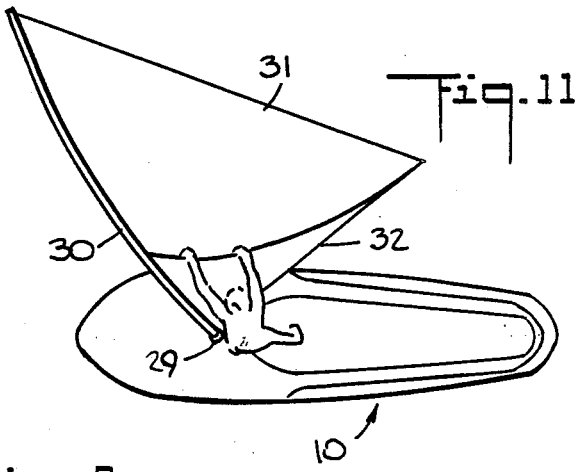
Fig. 11.
Fig. 10.
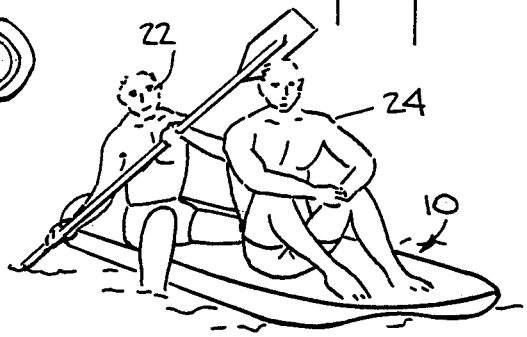
Fig. 8.
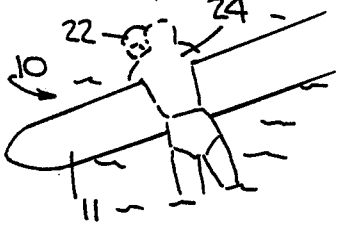
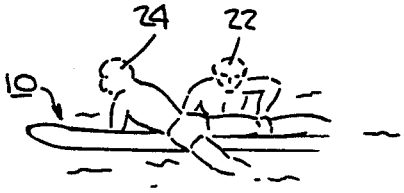
Fig. 9.

WATER CRAFT

This is a continuation of application Ser. No. 089,270, filed Aug. 25, 1987, now abandoned.

This invention relates to a water craft. More particularly, this invention relates to a water craft which is useful as a marine rescue and recreational craft.

Heretofore, various types of water craft have been known for use in rescue work as well as in recreational activities, for example, water craft such as surfboards and paddleboards have been used not only for rescue work but also for recreational purposes. For example, life guards often resort to paddleboards as a means for quickly reaching a distressed swimmer or a drowning non-swimmer and for transporting the victim to shore for first aid.

In the past, paddleboards have been constructed with features which are especially adapted for specific uses. For example, paddleboards have been fabricated with a pointed bow which is to be angled out of the water as well as with a convex underwater surface in order to achieve faster speeds when in use. In other cases, boards have been made with a concave underwater surface in order to provide lateral stability.

Where a surfboard or paddleboard is intended for rescue operations, such as for use by a lifeguard, the board is generally constructed of a size to permit the lifeguard to lie at the stern while the rescued person is laid flat along the bow and middle section of the board. However, where the boards are made with a rounded underwater surface, there is a danger that the boards may tip or roll over causing the rescued person to slide off.

Accordingly, it is an object of the invention to provide a craft which is capable of supporting a rescued victim in a stable position.

It is another object of the invention to provide a craft which can be rapidly moved through the water and which is sufficiently stable to expedite rescue operations.

It is another object of the invention to provide a craft which is capable of allowing the administration of first aid and cardio-pulmonary resuscitation on board.

It is another object of the invention to provide a craft for multiple uses such as for marine rescue and recreational purposes.

It is another object of the invention to provide a craft of board-like construction which can be readily navigated.

Briefly, the invention provides a water craft of one-piece buoyant construction which has a forward bow section, which is shaped and contoured to impart stability when moving through the water and a stern section which is shaped and contoured to improve the speed of the craft through the water. The bow section includes a pair of longitudinally disposed runners on an underside and a recessed central portion which extends longitudinally between the runners. The stern section includes a centrally disposed longitudinally extending chine on the underside which is disposed in spaced relation to the runners in order to define a pair of channels there between. The thus defined channels each extend from and communicate with the recessed central portion of the bow section in order to guide a flow of water therethrough.

The stern section of the craft also includes a flat centrally disposed deck on a top side which is angularly disposed relative to the bow section as well as a pair of foot rests on opposite sides of the deck, for example at mid-deck. This construction permits a user to be seated in a stable position, for example for paddling of the water craft through the water by use of a double-bladed paddle.

The stern section may also be provided with a depending rudder which extends from the rear end of the chine.

The craft has an overall shape which is contoured to enhance movement through the water. For example, the bow section may have a U-shape with the runners disposed in parallel while the stern section is of parabolic shape with a pair of lateral edges defining a converging angle towards a rear of the stern section.

The craft may also be provided with a means for mounting a mast for a sail on the bow section and a means for mounting a steering rudder on the stern section. With the sail in place, the craft can be used as a sail boat. In this embodiment, the flat deck on the stern section provides a stable surface on which a user may sit for sailing of the craft. Further, a center board blade may be pivotally mounted in the underside of a mid-section for pivoting into a depending position for sailing purposes.

The craft may also be provided with a means for mounting a hand-supported mast, which supports the sail vertically, and tubular bars of wishbone configuration, which support the sail horizontally. The mast is then inserted into a mast foot with a universal joint, which is then attached to a mast step which has been imbedded within the craft. With the sail in place, the craft can be used as a windsurfer. In this embodiment, the flat deck provides a stable surface on which the user may stand while sailing the craft. Further, a center board blade may be pivotally mounted in the underside midsection for pivoting into a depending position for sailing purposes.

Where the craft is to be used for rescue purposes, the top side of the bow section is made flat. In this case, where a lifeguard has navigated to the location of the person requiring rescue, the swimmer can be positioned on the bow section either in a prone position or in a seated upright position for return to land. At this time, the lifeguard would be seated on the stern section and would paddle the craft to land, for example using a double-bladed paddle. Alternatively, the craft can be navigated through the use of a lifeguard's hands.

These and other objects and advantages of the invention will become more apparent from the following detailed description taken in conjunction with the drawings wherein:

FIG. 1 illustrates a view of a craft according to the invention in use for the rescue of a distressed swimmer;

FIG. 2 illustrates a view of the craft of FIG. 1 in use as a sail boat in accordance with the invention;

FIG. 3 illustrates a top side view of the craft of FIG. 1;

FIG. 4 illustrates an underside view of the craft of FIG. 1;

FIG. 5 illustrates a perspective view of the craft of FIG. 1;

FIG. 6 illustrates a front view of the craft of FIG. 1;

FIG. 7 illustrates a view taken on line 7—7 of FIG. 5;

FIG. 8 illustrates a position of a distressed swimmer relative to the craft of FIG. 1 during a rescue operation;

FIG. 9 illustrates a position for a rescued swimmer during a further step in a rescue operation;

FIG. 10 illustrates a position of a rescued swimmer on the craft during a final phase of a rescue operation; and FIG. 11 illustrates a perspective view of the craft in use as a windsurfer.

Referring to FIG. 1, the water craft 10 is of generally flat board-like shape, for example having an overall length of about twelve feet, a width of about three feet at the widest point and a thickness of about seven inches at the thickest part. The craft is made of bouyant material as well as being of light weight construction to be readily transported by a single person. For example, the board may be formed with a core of foam plastic and an outer sheath of non-foamed plastic.

Referring to FIG. 3, the water craft 10 has a forward bow section 11 and a rear stern section 12. As indicated, the bow section 11 is of U-shape while the stern section 12 has a parabolic shape with a pair of lateral edges which define a converging angle towards the rear of the stern section 12. The shape is one which is intended to enhance the streamline nature of the craft 10 and to improve the speed of the craft 10 through the water.

Referring to FIG. 4, the bow section 11 includes a pair of longitudinally disposed parallel runners 13 on the underside along the respective edges of the bow section 11 as well as a recessed central portion 14 which extends longitudinally between the runners 13. Each runner 13 presents a flat or slightly rounded surface on the underside which extends in a single horizontal plane as viewed in FIG. 6 while merging at the forward end into the bow section 11 and merging at the rear and into the stern section 12. As indicated in FIG. 4, the recessed central portion 14 has a generally flat middle portion which is symmetrical to a longitudinal axis 15 of symmetry of the craft 10 as well as a pair of curved sections which extend from the central section to the respective runners 13. For example, the flat central portion may have width of six inches while each runner 13 has a width of seven inches with the total width of the bow section at the widest point being thirty-six inches.

As indicated in FIG. 5, the runners 13 merge into the forward portion of the bow section 11 so as to leave an unobstructed recess into which water may flow during navigation in order to minimize resistance to the flow of water and thus to permit the craft 10 to achieve a greater speed. The pair of runners 13 also impart stability to the craft 10 to increase resistance to capsizing.

Referring to FIGS. 4 and 5, the stern section includes a centrally disposed longitudinally extending chine or rib 16 on the underside which is disposed in spaced relation to the runners 13 in order to define a pair of channels 17 there between. As indicated, each channel 17 extends from and communicates with the recessed central portion 14 of the bow section 11 so as to guide a flow of water therethrough. As indicated in FIG. 7, the chine 16 presents a flat bottomed surface which is co-planar with the flat surfaces of the runners 13. In addition, the forward end of the chine 16 converges to an apex located between the runners 13 in order to facilitate a separation of a flow of water from the recessed portion 14 of the bow section 11 into the two channels 17.

The stern section 12 is also provided with a depending rudder 18 which extends from a rear end of the chine 16.

Referring to FIG. 3, the top side of the stern section 12 is provided with a flat or recessed centrally disposed deck 19 and a pair of footrests 20 on opposite sides of the deck 19. As indicated in FIGS. 1 and 3, the deck 19 is angularly disposed relative to the bow section 11 such that the rear end of the deck 19 is lower than the forward end of the deck 19. As also indicated, the stern section 12 has a pair of longitudinally disposed recesses 21 which extend from the respective footrests 20 along an edge of the stern section 12. As indicated in FIG. 7, each recess 21 has an arcuate contour and merges in a smooth manner into a respective footrest 20.

As shown in FIG. 1, with a person, such as a lifeguard, 22 seated on the deck 19 of the stern section 12, the feet of the lifeguard 22 can be placed against the footrests 20. In this position, use may be made of a double-bladed paddle 23 for navigating the craft 10 through the water, for example, to a swimmer 24 in distress.

Referring to FIGS. 3 and 6, the top side of the bow section 11 is flat so as to provide a platform for receiving a person in a prone or seated position.

As indicated in FIG. 4, each runner 13 gradually tapers in width in a rearward direction. In this case, the rear ends of the runners 13 define an opening in the side of the craft 11 opposite the chine,,. 16 so as to permit water from the channels 17 to be guided laterally out and away from the craft. Alternatively, the runners 13 may become gradually depressed into the stern section 12 to permit water to flow out from the sides of the craft 10. Still further, each channel 17 may be tapered to decrease in depth while eventually disappearing at the lateral sides of the stern section 12.

The shape and contour of the underside of the craft 10 combines the features of a multi-hull which is characteristic of a catamaran in the bow section 11 with the characteristics of a mono-hull which is characteristic of a conventional surfboard in the stern section 12 in order to achieve high stability as in a catamaran and the reserve stability of a mono-hull.

Where the craft 10 is to be used for rescue purposes, a lifeguard 22 would be seated on the stern section 12 as indicated in FIG. 1 and would paddle to the location of a distressed swimmer or a drowning victim 24. Should the need arise, the craft 10 could be propelled through the water by hand.

During navigation through the water, the shape at the underside of the craft 10 permits a relatively high speed to be obtained as compared with previously known boards for similar purposes. Once reaching the location of the victim 24, the lifeguard 22 may pull the victim 24, as indicated in FIG. 8, over a mid-section of the craft 10. After positioning the victim 24 over the craft 10 the lifeguard 22 may turn the victim 90 degrees as indicated in FIG. 9 into a position parallel to the craft 10. The rescued person 24 may remain in this position or may move into a seated position, as indicated in FIG. 10, for return to land. For the return trip, the lifeguard 22 would again be seated in the stern section 12 and would use the paddle indicated in FIG. 1 for paddling to land.

The flat top side of the bow section 11 indicated in FIGS. 3 and 6 permit the rescued person 24 to be laid or seated in a stable position. Of note, it is also possible for a lifeguard 22 to perform artificial respiration or cardiopulmonary resuscitation and the like on the rescued person 24 while still in the water. In this respect, should a pulseless non-breathing victim be rescued a moderate distance from shore, the lifeguard may be able to quickly ventilate the victim's lungs while the victim is in a prone position on the craft 10. Thus, there can be a reduction in the risk that a victim may suffer irreversible brain damage or death because a rescuer was unable to externally compress the victim's sternum to force blood out of the heart through the lungs and into the brain. The size and stability of the craft permits a lifeguard to attempt to perform both cardiac compressions and respiratory ventilations on a prone victim on the craft. In this respect, ventilation of the lungs can be attempted by a lifeguard also on the craft or by a second lifeguard who remains in the water.

Referring to FIG. 2, the water craft 10 may also be be provided with a means 25 adjacent the forward end of the deck 19 for mounting a mast 26 for a sail 27. Such a means 25 may be in the form of a bracket which is permanently secured to the bow section 11 or which can be removably mounted in place or in the form of a recessed hole in the deck 19.

The water craft 10 may also be provided with a means 27 for mounting a rudder 28 on the rear of the stern section 12. This means 26 may be in the form of a suitable bracket assembly which can be permanently mounted on the craft 10 or removably mounted in known manner.

The use of the spaced apart runners 13 on the underside of the bow section 11 and the relatively wide flat chine 16 on the underside of the stern section 12 provides stability for a user when seated on the flat deck 19 as indicated in FIG. 1. In addition, the shaping of the underside of the bow section of a recessed central portion 14 and the two channels 17 extending therefrom enhance the speed characteristics of the craft 10 when being propelled through the water. In this respect, the profile of the craft 10 which is presented to the water is of a very reduced minimum in the bow section.

The craft 10 may also be provided with inserts or recesses in the deck 19 alongside the recesses 21 in order to hold unsleeved double bladed kyack paddles.

Referring to FIG. 11, the craft 10 may have a mast step 29 to receive a mast foot in which a mast 30 is mounted via a universal joint for use as a wind-surfer. As indicated, the mast 30 supports a sail 31 along with horizontal support bars 32.

The invention thus provides a water craft which can be readily used for marine rescue purposes as well as a water craft which can be readily used for recreation purposes, for example, in the form of a kyack, a windsurfer and a sail boat. In this respect, the craft is constructed to permit interchangeability from one function to another either while on shore or in the water.

For example, the craft can be used in the manner of a kyack, that is, propelled through the water with a double bladed paddle, with the mast inserted into the deck of the craft with the sails furled. At a time deemed appropriate by the user, the paddles can be unsleeved and inserted into receptacles on either the top side of the bow deck, or along the outside lateral chines. The sail would then be unfurled and the craft used as a sailboat. In like manner, the mast could be removed from the deck of the craft, inserted into a mast foot with a universal joint, and sailed as windsurfer.

Where the craft is propelled through the water, an individual may be seated on the top side of the stern section in a stable manner with his feet braced in the footrests. Such stability greatly surpasses the stability of traditional surfboards where smooth slightly convex undersides render the boards somewhat unstable and easily tippable.

Where used as a windsurfer, a mast can be attached to the craft with a universal joint or like means and may be supported in an upright position by the user. Because of the stability of the craft, a novice windsurfer may quickly master the skills necessary to balance oneself on the craft. Thus, instead of concentrating on learning the skills of balancing, the user may concentrate on the skills required for sailing.

The invention further provides a water craft which is of generally light-weight construction so as to be easily transported by a single person. Further, the craft may be made of any suitable size so as to accommodate the use for which the craft may be intended.

What is claimed is:

1. A water craft of flat board-like shape having a forward bow section including a pair of longitudinally disposed runners on an underside and an unobstructed recessed central portion extending longitudinally between said runners; and a parabolically shaped stern section with a pair of lateral edges defining a converging angle, said stern section including a centrally disposed longitudinally extending chine in an underside of said stern section extending within the plane of said runners and disposed in laterally spaced relation to said runners to define a pair of channels therebetween, each said channel extending from and communicating with said recessed central portion of said bow section, said chine having a flat bottomed surface and a forward end converging to an apex between said runners.

2. A water craft as set forth in claim 1 wherein said bow section is of U-shape with said runners disposed in parallel.

3. A water craft as set forth in claim 1, characterized in being made of buoyant material.

4. A water craft as set forth in claim 1 wherein said stern section includes a flat centrally disposed deck on a topside and a pair of foot rests disposed on opposite sides of said deck.

5. A water craft as set forth in claim 4 wherein said stern section has a pair of longitudinally disposed recesses, each recess extending from a respective foot rest along an edge of said stern section.

6. A water craft as set forth in claim 4 wherein said deck is angularly disposed relative to said bow section.

7. A water craft as set forth in claim 6 wherein said bow section has a flat topside surface merging into said deck.

8. A water craft as set forth in claim 7 wherein said stern section includes a depending rudder extending from a rear end of said chine.

9. A water craft as set forth in claim 1 wherein each runner is disposed along an edge of said bow section.

10. A water craft as set forth in claim 9 wherein said chine extends across said stern section and each said channel extends to a side of said stern section.

11. A water craft as set forth in claim 1 wherein each runner has a surface on an underside co-planar with said bottomed surface of said chine.

12. A water craft of board-like shape having a U-shaped bow section including a pair of longitudinally disposed runners on an underside and an unobstructed recessed central portion extending longitudinally between said runners; and a parabolically shaped stern section including a centrally disposed longitudinally extending chine on an underside disposed in spaced relation to said runners to define a pair of channels therebetween, said chine extending across said stern section from side to side with each said channel communicating with said recessed central portion of said bow section and extending from said central portion laterally outwardly to a side of said stern section.

13. A water craft as set forth in claim 12 wherein said stern section includes a flat centrally disposed deck on a topside disposed in angular relation to said bow section.

14. A water craft as set forth in claim 13 wherein said stern section includes a pair of foot rests on opposite sides of said deck and a pair of longitudinally disposed recesses, each recess extending from a respective foot rest along an edge of said stern section.

15. A water craft as set forth in claim 12 wherein said chine has a flat surface and narrows to an apex at a forward end between said channels.

16. A water craft comprising a buoyant one-piece body having a bow section including a pair of longitudinal runners on an underside and an obstructed recessed central portion between said runners and a parabolically shaped stern section with a pair of lateral ends defining a converging angle, said stern section including a chine on an underside extending within the plane of said runners and laterally spaced from said runners to define a pair of channels therebetween, each said channel extending from and communicating with said recessed central portion, said chine having a flat bottomed surface and a forward end converging to an apex between said runners;

means for mounting a mast for a sail on said bow section; and means for mounting a rudder on said stern section.

17. A water craft as set forth in claim 16 wherein said stern section includes a flat centrally disposed deck on a topside disposed in angular relation to said bow section.

18. A water craft as set forth in claim 17 wherein said stern section includes a pair of foot rests on opposite sides of said deck.

19. A water craft as set forth in claim 17 wherein said chine has a flat surface opposite from said deck.

20. A water craft as set forth in claim 16 further comprising a depending rudder extending from a rear end of said chine.

21. A water craft as set forth in claim 16 wherein each runner defines an opening in a side of said body opposite said chine to permit water in a respective channel to flow out from said side.

* * * * *

UNITED STATES PATENT AND TRADEMARK OFFICE

CERTIFICATE OF CORRECTION

PATENT NO. : 4,894,035

DATED : Jan. 16, 1990

INVENTOR(S) : FRANCESCO A. PIA

It is certified that error appears in the above-identified patent and that said Letters Patent is hereby corrected as shown below:

Column 6, line 48 change "7" to --4--

Column 4, line 22 change "chine,,.16" to --chine 16--

Signed and Sealed this

Eleventh Day of June, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,894,035

DATED : January 16, 1990

INVENTOR(S) : WATER CRAFT

It is certified that error appears in the above-identified patent and that said Letters Patent is hereby corrected as shown below:

Col. 7, line 19 change "obstructed" to -unobstructed-

Signed and Sealed this

Twenty-sixth Day of May, 1992

*Attest:*

DOUGLAS B. COMER

*Attesting Officer*

*Acting Commissioner of Patents and Trademarks*